United States Patent [19]

Fleisher

[11] Patent Number: 4,478,477

[45] Date of Patent: Oct. 23, 1984

[54] ELECTRICAL WIRE CONNECTOR HOLDER

[75] Inventor: Larry D. Fleisher, Maplewood, Minn.

[73] Assignee: Minnesota Mining and Manufacturing Company, St. Paul, Minn.

[21] Appl. No.: 388,888

[22] Filed: Jun. 16, 1982

[51] Int. Cl.[3] ..... H01R 9/00

[52] U.S. Cl. ..... 339/198 G

[58] Field of Search ..... 339/198 G, 198 GA, 199 R, 339/60 M, 119 R, 121, 126 R, 198 H

[56] References Cited

U.S. PATENT DOCUMENTS

| | | | |
|---|---|---|---|
| 3,471,822 | 10/1969 | Van Balen | 339/198 G |
| 3,576,520 | 4/1971 | Stauffer | 339/198 G |
| 3,728,668 | 4/1973 | Reinisch | 339/198 G |
| 3,937,550 | 2/1976 | Gillemot | 339/198 G |
| 4,171,861 | 10/1979 | Hohorst | 339/198 G |

FOREIGN PATENT DOCUMENTS

| | | | |
|---|---|---|---|
| 1550770 | 12/1971 | Australia | 339/198 G |
| 1456087 | 11/1976 | United Kingdom | 339/198 GA |

*Primary Examiner*—William R. Briggs

*Attorney, Agent, or Firm*—Donald M. Sell; James A. Smith; Terryl K. Qualey

[57] ABSTRACT

A unitary molded plastic holder for a multiplicity of wire connectors of the type wherein a body and cover are crimped together after insertion of the wires between them. The holder has an elongate body with a multiplicity of electrical wire connector receptacles in two rows, one row on each of the opposing longitudinal surfaces of the body with each connector receptacle in one row being in back-to-back relation to a connector receptacle in the other row. An electrical connector is received, supported and releasably latched in each receptacle, both in the open and crimped positions of the connector.

3 Claims, 3 Drawing Figures

ELECTRICAL WIRE CONNECTOR HOLDER

FIELD OF THE INVENTION

The present invention relates to an electrical wire connector holder for a multiplicity of electrical wire connectors.

BACKGROUND OF THE INVENTION

Small discrete electrical wire connectors are frequently used to splice together the hundreds of pairs of wires in adjoining telephone cable ends and to branch off of the main cable. These connectors are commonly of a type wherein a plastic body and cover are latched in an open position, wires to be connected are inserted between them and they are pressed together to a crimped position to connect the wires in an insulation displacement contact element within the connector. Because each telephone cable consists of hundreds of pairs of wires, each connection must only take a small amount of space. Where many discrete connectors are used at a single location the wires and connectors are bundled tightly together after the connections are made and placed in an enclosure. In the process of bundling the wires and connectors together it is not practical to keep any order to the connectors that would permit ready identification of particular circuits if servicing is necessary.

Various electrical wire connector holders are disclosed in the art as exemplified by the holders of U.S. Pat. Nos. 3,471,822; 3,456,231; 3,474,392; 3,576,520; 3,705,377; 3,728,668 and 3,824,553. However, none of these patents provide a holder for the small telephone wire connectors described above.

SUMMARY OF THE INVENTION

The present invention provides a unitary molded plastic holder for a multiplicity of electrical wire connectors of the type wherein a plastic body and cover are latched in an open position, wires to be connected are inserted between them and they are pressed together to a crimped position to connect the wires in an insulation displacement contact element within the connector. The holder is an elongate body having a multiplicity of electrical wire connector receptacles in two rows, one row of connector receptacles being on each of two opposing longitudinal surfaces of the elongate body with each connector receptacle in one row being in back-to-back relation to a connector receptacle in the other row. Each receptacle is formed to receive and support an electrical wire connector in its latched open position for receipt of wires to be connected and connector latching means is provided for each of the receptacles for releasably retaining an electrical wire connector in its latched open position and in its crimped position.

The electrical wire connector holder of the present invention provides for organizing a multiplicity of electrical wire connectors to facilitate identification of a particular circuit and it provides a compact design with a separate receptacle and separate releasable retention for each connector to permit servicing of the individual connectors.

THE DRAWING

DESCRIPTION OF THE PREFERRED EMBODIMENT

Figure 1:
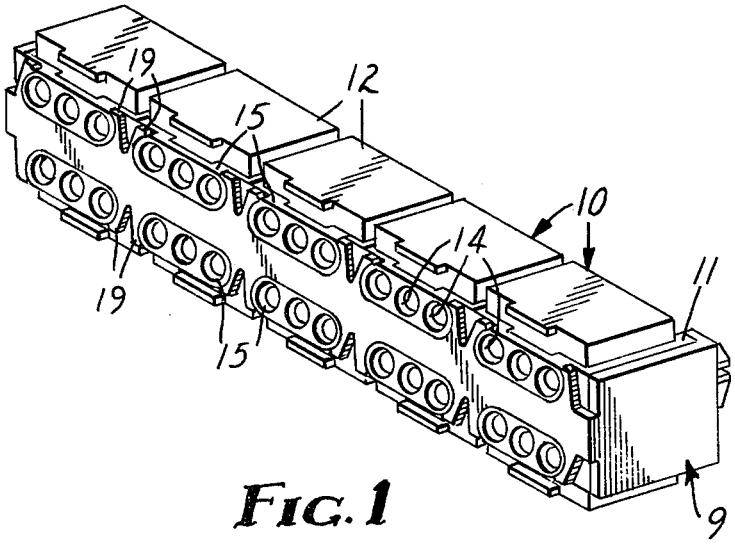
FIG. 1 is a perspective view of an electrical wire connector holder constructed in accordance with the present invention and holding ten electrical wire connectors in their open positions.
Figure 2:
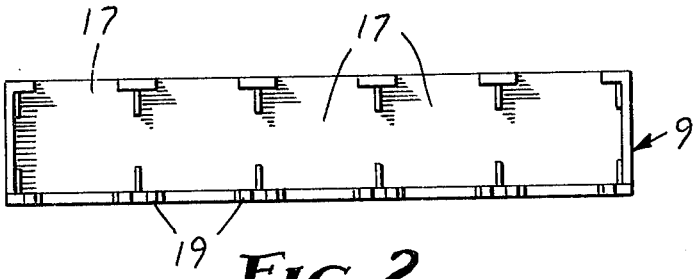
FIG. 2 is a top view of the holder with the connectors removed, the bottom view being the same.
Figure 3:
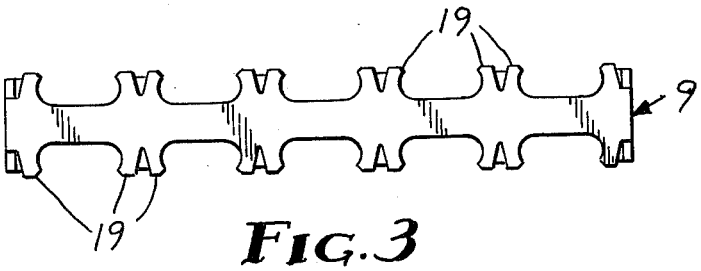
FIG. 3 is a front elevation view of the holder.

The holder 9 of the present invention is designed to hold a multiplicity of electrical wire connectors 10 which have a plastic body 11 and cover 12 that are latched in an open position as sold. Wires to be connected are inserted between the body and cover 11 and 12, in the illustrated connector by inserting the wire ends into wire insertion ports 14 formed in an extension 15 at one end of the body 11. To electrically connect the wires, the body and cover are pressed together to a crimped position which forces the wires into an insulation displacement contact element within the connector which cuts through the insulation on the wires and makes electrical connection to the conductors thereof.

The holder 9 is a single molded plastic piece, preferably formed of polypropylene. It has an elongate body with a multiplicity of electrical wire connector receptacles 17 in two rows, one row of connector receptacles 17 being on each of two opposing longitudinal surfaces of the body with each connector receptacle in one row being in back-to-back relation to a connector receptacle in the other row. In the illustrated embodiment there are five receptacles 17 on each surface because 10 is a multiple often worked with in connecting telephone cables. Each receptacle 17 is formed to receive and support an electrical wire connector 10 in its latched open position with the wire insertion ports 14 exposed for receipt of wires to be connected.

Connector latching means is provided for each of the receptacles 17 for releasably retaining an electrical wire connector in its latched open position and in its crimped position. In the illustrated embodiment the connector latching means is a pair of arcuate resilient fingers 19 for each receptacle 17 adjacent one edge of the holder for snapping around and resiliently engaging the wire port extension 15 of the connector 10. Other latching means may also be used, and will be required with other connectors, so long as they satisfy the requirement that they hold the connector in both the open position and the crimped position and that they do not interfere with insertion of wires when the connector is in the open position.

Typically the holder 9 will be sold with the connectors 10 in their open position retained therein as illustrated in FIG. 1. In use, wires are inserted into the wire insertion ports 14 in two opposing connectors 10 and the two connectors may then be crimped simultaneously to connect three tip wires in one of the connectors and three ring wires in the opposing connector to create a branch circuit. The remaining connectors may then be used in a similar manner. If servicing is required, each of the connectors may be individually removed from the holder 9, a new connector may be applied and then snapped back into the holder 9.

I claim:

1. A unitary molded plastic holder for a multiplicity of electrical wire connectors of the type wherein a plastic body and cover are latched in an open position, wires to be connected are inserted between them and they are pressed together to a crimped position to connect the wires in an insulation displacement contact element within the connector, comprising an elongate body having a multiplicity of electrical wire connector receptacles in two rows, one row of connector receptacles being on each of two opposing longitudinal surfaces of said elongate body with each connector receptacle in one row being in back-to-back relation to a connector receptacle in the other row, each said receptacle being formed to receive and support a said electrical wire connector in its latched open position for receipt of wires to be connected, and resilient connector latching means for each of said receptacles into which a said electrical wire connector can be snapped for releasably retaining a said electrical wire connector in its latched open position and in its crimped position in a manner permitting a said electrical connector to be removed therefrom by pulling on the connector.

2. An electrical wire connector holder as recited in claim 1 for electrical wire connectors having a wire port extension at one end wherein said connector latching means for each said receptacle comprises a pair of arcuate resilient fingers adjacent one edge of said holder for snapping around and resiliently engaging a said wire port extension of a said connector.

3. An electrical wire connector holder as recited in claim 1 or 2 wherein there are five of said connector receptacles in each row.

* * * * *